United States Patent [19]

Benson

[11] Patent Number: 4,542,777

[45] Date of Patent: Sep. 24, 1985

[54] CARRYING CASE

[76] Inventor: Benjamin A. Benson, 7320 Voss Pkwy., Middleton, Wis. 53562

[21] Appl. No.: 613,419

[22] Filed: May 24, 1984

[51] Int. Cl.[4] ..... A45C 11/34; A45C 11/36; B42F 15/00

[52] U.S. Cl. ..... 150/52 B; 190/109; 206/224; 206/371; 206/425; 220/23; 312/184

[58] Field of Search ..... 190/111, 109; D3/74, D3/76, 30.1; 206/425, 816, 316, 224, 371; 312/184; 150/52 B, 52 J; 229/9, 10; 220/23

[56] References Cited

U.S. PATENT DOCUMENTS

| | | | |
|---|---|---|---|
| D. 5,087 | 7/1871 | Seldis | D3/74 |
| 87,591 | 3/1869 | Rice | 312/184 |
| D. 102,554 | 12/1936 | Hassenfeld | D3/74 |
| D. 194,525 | 2/1963 | D'Arcy | D3/74 |
| D. 246,549 | 11/1977 | Crane | D3/30.1 X |
| D. 249,393 | 9/1978 | Winther | D3/30.1 |
| 698,558 | 4/1902 | Rosenbaum | 190/111 |
| 1,083,292 | 1/1914 | Mudd | 312/184 |
| 1,217,243 | 2/1917 | Tucker et al. | 206/425 X |
| 1,650,672 | 11/1927 | Walinsky | 190/111 |
| 1,887,539 | 11/1937 | Brown | 312/184 X |
| 2,053,599 | 9/1932 | Brinkerhoff | 206/816 X |
| 2,875,010 | 2/1959 | Sola et al. | 220/20 X |
| 3,164,430 | 1/1965 | Beem et al. | 206/425 X |
| 3,392,903 | 7/1968 | Morgan, Jr. | 229/27 |
| 3,904,003 | 9/1975 | Margerum | 190/11 |
| 3,912,055 | 10/1975 | Malooly | 190/112 X |
| 4,020,930 | 5/1977 | Weber | 190/111 X |
| 4,034,891 | 7/1977 | Mecham | 206/316 X |
| 4,208,826 | 6/1980 | Lindaman | 206/811 X |
| 4,330,050 | 5/1982 | Sangster et al. | 206/425 X |
| 4,335,812 | 6/1982 | Koues | 206/1.8 |
| 4,366,904 | 1/1983 | Roskvist | 206/425 |

FOREIGN PATENT DOCUMENTS

| | | | |
|---|---|---|---|
| 966452 | 4/1975 | Canada | 190/111 |
| 1078868 | 3/1960 | Fed. Rep. of Germany | 150/52 J |
| 2809705 | 9/1979 | Fed. Rep. of Germany | 206/425 |
| 615757 | 10/1926 | France | 190/109 |
| 1008601 | 5/1952 | France | 312/184 |

*Primary Examiner*—William Price
*Assistant Examiner*—Sue A. Weaver
*Attorney, Agent, or Firm*—Isaksen, Lathrop, Esch, Hart & Clark

[57] ABSTRACT

A carrying case adapted to conveniently contain writing materials. A carrying case has a lower portion having inwardly facing surfaces that define an upwardly opening file chamber having a lower portion rim. An upper portion has inwardly facing surfaces that define a storage chamber having an upper portion rim. A panel is adapted to move between a closed position and an open position to selectively close and open the storage chamber. Means are provided for removably fastening the upper portion rim to the lower portion rim to thereby close the file chamber.

16 Claims, 4 Drawing Figures

CARRYING CASE

TECHNICAL FIELD

The present invention relates to carrying cases in general and, in particular, to carrying cases adapted to conveniently contain writing materials and similar objects.

BACKGROUND OF ART

Those skilled in the art are cognizant of a variety of carrying cases to facilitate the transport or storage of writing materials such as papers, notebooks, folders, and the like together with writing utensils. Some include separate sections for papers and for writing utensils, Margerum, U.S. Pat. No. 3,904,003, being an example. Malooly, U.S. Pat. No. 3,912,055 is another example, in which a hinged lid portion of a carrying case has an auxillary openable panel, allowing access to a file folder portion of the carrying case independent of access to the remainder of the case. Crane, U.S. Pat. No. D246,549 is typical of carrying cases in which several sections are clustered together and independently close, the various sections being especially designed to hold particular instruments or papers. Koves, U.S. Pat. No. 4,335,812 discloses an expandable portion adapted to contain papers and a second, subdivided portion adapted to contain artist supplies. The Koves carrying case is equipped with a strap to allow the case to be carried over the shoulder of the user. Sloop, U.S. Pat. No. 4,323,180 and Lindaman, U.S. Pat. No. 4,208,826 are similarly equipped with shoulder straps.

A number of carrying cases have box-like lids that open to reveal a correspondingly box-like lower portion adapted to carry papers or files. Examples include D'Arcy, U.S. Pat. No. D194,525; Winther, U.S. Pat. No. D249,393; and Sola, U.S. Pat. No. 2,875,010. A wide variety of paper cases, satchels, and receptacles of miscellaneous design containing subdivisions for papers and supplies also exist, of which Hassenfeld, U.S. Pat. No. D102,554 and Morgan, U.S. Pat. No. 3,392,903 are examples.

Those skilled in the art are not cognizant of a carrying case including a lower part adapted to contain files, notebooks, or the like and to be carried by the user with a convenient, over-the-shoulder strap attached thereto, and a rigid, independently closeable container adapted to contain writing implements and comparable small items and to itself serve to close the first container while at the same time being completely removable therefrom.

BRIEF SUMMARY OF THE INVENTION

The present invention is summarized in that a carrying case adapted to conveniently contain writing materials includes a lower portion having inwardly facing surfaces that define an upwardly opening file chamber having a lower portion rim and an upper portion having inwardly facing surfaces that define a storage chamber having an upper portion rim. A panel is adapted to move between a closed position and an open position to selectively close and open the storage chamber. Means are provided for removably fastening the upper portion rim to the lower portion rim to thereby close the file chamber.

A primary object of the invention is to provide a carrying case subdivided into a portion for carrying papers and other flat materials in an orderly way and a second portion adapted to separately contain writing implements or other small objects.

A second object to the invention is to provide for such a carrying case capable of withstanding considerable physical buffeting and abuse.

Another object of the invention is to provide such a carrying case in which the two container portions can be entirely separated from each other and dealt with independently.

A further object of the invention is to provide such a carrying case capable of holding hanging files or comparable means for holding and organizing a set of papers.

Yet another object of the invention is to provide such a carrying case in which the portion adapted to carry writing implements serves as a lid for reliably closing the portion adapted to carry papers.

A further object of the invention is to provide such a carrying case adapted to be hung in a school locker or conveniently carried about by a user by means of a strap that is attached to the carrying case and has sufficient length to allow the case to be conveniently suspended from the user's shoulder.

Yet another object of the invention is to provide a design for such a case that can be conveniently manufactured by conventional plastic molding techniques.

Other objects, features, and advantages of the invention will be apparent from the following detailed description taken in conjunction with the accompanying drawings showing a preferred embodiment of a carrying case exemplifying the principles of the invention.

DETAILED DESCRIPTION OF THE PREFERRED EMBODIMENT

Figure 1:
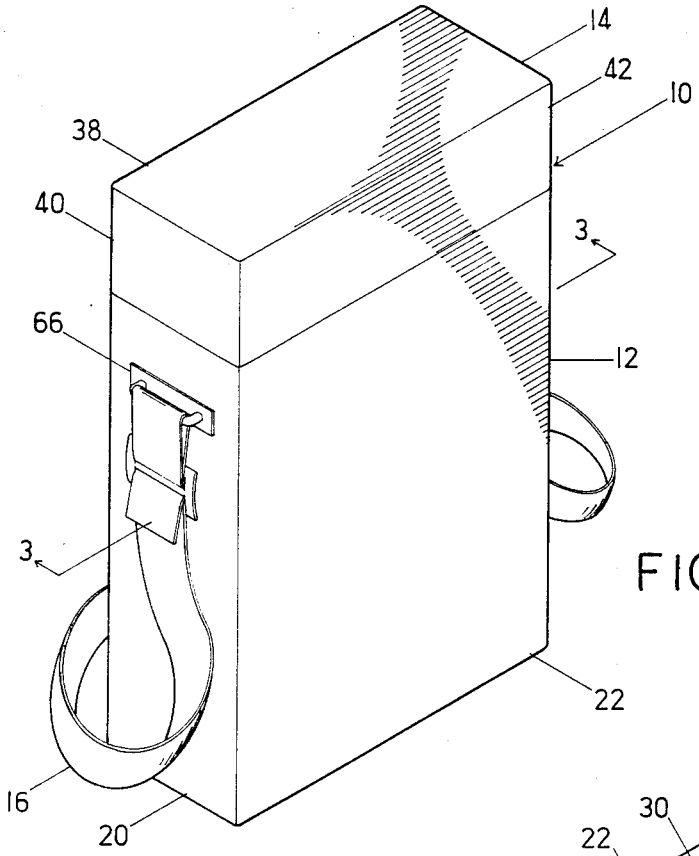
FIG. 1 is a perspective view of the preferred embodiment of the carrying case of the invention.

Referring more particularly to the drawings, wherein like numbers refer to like parts, FIG. 1 shows a carrying case, generally indicated at 10, constructed in accord with the present invention. The carrying case 10 has a lower portion 12 adapted to contain files, spiral notebooks, pocket folders, papers, and the like, and an upper portion 14 removable from the lower portion and independently closeable. The upper portion 14 is adapted to contain pencils, rulers, and other comparable objects. A strap 16 is attached to the lower portion 12 to provide means for conveniently carrying the case 10. Preferably the strap 16 is sufficiently long that the carrying case 10 may be conveniently suspended from the shoulder of the user.

The lower portion 12 is generally rectangular and box-like, with a floor 18, two opposed lower portion ends 20, and two opposed lower portion sides 22, the upwardly presenting portions of the ends and sides combining to define a rim 24. Inwardly facing surfaces of the floor 18, lower portion ends 20, and lower portion sides 22 define an upwardly opening file chamber 26. The file chamber 26 has a size selected to be sufficient to contain files, notebooks, or papers suspended vertically from the vacinity of the rim 24 by means disclosed below.

The lower portion 12 includes file hangers 28 projecting inwardly from the lower portion ends 20 into the file chamber 26 at a selected distance beneath the level of the rim 24. The distance between the file hangers 28 of the opposed lower portion ends 20 is selected to be such that hanging files such as those shown at 30 may be suspended therefrom. Typically such a file 30 depends from downwardly presenting side hooks located at each upper corner of the file 30, such the side hooks shown at 32. Preferably the side hooks 32 of the hanging files 30 employed with the carrying case 10 of the invention have downwardly extending projections 34. The upwardly presented surfaces of the file hangers 28 may be generally flat. Alternatively, each file hanger 28 may have an upwardly opening trough 36 extending substantially the length of the file hanger and adapted to receive the downwardly extending projections 34 to help retain the side hooks 32 in place on the file hangers.

The upper portion 14 of the carrying case 10 has a roof 38 and upper portion opposed ends 40 and opposed sides 42 corresponding in length to the lower portion ends 20 and sides 22. The upper portion 14 is adapted to removably fit on top of the lower portion 12 to close the upwardly opening file chamber 26. The lower and upper portions 12, 14 may be hinged or otherwise fastened to each other, but preferably the upper portion may be entirely removed from the lower portion, as is shown in the embodiment set forth in the figures. With the upper portion 14 removed and inverted so that the roof 38 is held downwardmost, inwardly facing surfaces of the roof, upper portion ends 40, and upper portion sides 42 define a then upwardly opening storage chamber 44. The upper portion ends and sides 40, 42 terminate in an upper portion rim 46 remote from the roof 38.

A raised tongue 48 extends from the upper portion rim 46 in a direction away from the roof 38. Preferably the tongue 48 extends entirely around the rim 46 and is of a size such that it extends within the file chamber 26 when the upper and lower portion rims 24, 46 are placed adjacent to each other, effectively locating the upper portion 14 on the lower portion 12 to close the file chamber. The tongue 48 has opposed tongue sides and ends 50, 52 adjacent respectively to the upper portion sides and ends 42, 40.

The tongue ends 52 have a ridge 54 extending endwardly generally parallel to the upper portion rim 46. The interior surface of each lower portion end 20 includes an indentation 56 located between the lower portion rim 24 and the file hanger 28 associated with the lower portion end. The indentation 56 is of a size and is so spaced from the lower portion rim 24 that the ridge 54 of the upper portion 14 snugly fits therein when the upper and lower portion rims 46, 24 are placed adjacent to each other. Preferably at least one of the upper portion 14 and lower portion 12 is made of a resilient material such as a plastic, so that as the tongue 48 slides within the file chamber 26, each ridge 54 resiliently snaps within the corresponding indentation 56 to removably retain the upper portion 14 in place on the lower portion 12. Taken together, the ridges 54 and indentations 56 constitute retaining means for releasably retaining the upper portion 14 on the lower portion 12 with the upper and lower portion rims 46, 24 adjacent to each other. It will be apparent that mechanical latches and other devices and structures could be substituted as equivalent retaining means within the scope and spirit of the invention.

The upper portion 14 also has a generally rectangular panel 58 adapted to close the storage chamber 44. Preferably each tongue side 50 has a panel slot 60 extending parallel to the upper portion rim 46 for substantially the length of the tongue side. At least one and preferably both tongue ends 52 have a panel opening 62 aligned with the panel slots 60 and extending parallel to the upper portion rim 46. The panel opening 62 is of a size selected to be sufficient that the panel 58 can readily slide therethrough.

Figure 4:
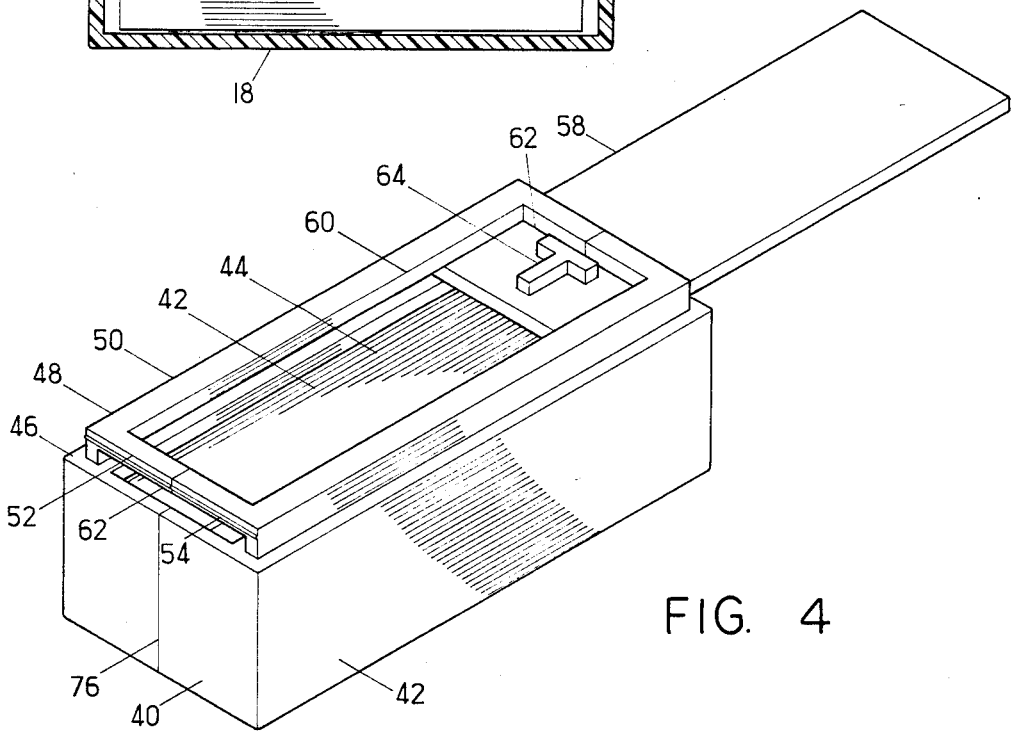
FIG. 4 is a perspective view of the upper portion of the carrying case of FIG. 1, inverted with the sliding panel in the open position.

The panel 58 is adapted to slide within the panel openings 62 and panel slots 60 between an open and a closed position. When the panel 58 is in its open position, as is shown in FIG. 4, the storage chamber 44 is predominantly uncovered and easy access may be had thereto. In this position, the panel 58 extends outwardly from one of the tongue ends 52 through the panel opening 62 of that tongue end. A panel handle 64 is attached to the panel 58 and is adapted to contact the tongue end 52 through which the panel extends when the panel is moved to its open position, thereby preventing complete removal of the panel. When the panel 58 is in its closed position, the storage chamber 44 is substantially closed, and each end of the panel extends within the panel opening 62 of the tongue end 52 adjacent thereto. The panel handle 64 preferably is adapted, when the panel 58 is in its closed position, to contact the tongue end 52 opposite to that through which the panel extends when the panel is in its open position. By this means, the movement of the panel 58 as a user slides it toward its closed position is limited. Preferably, the location of the panel 58 when in its closed position is such that the panel is contained entirely within the panel slots 60 and panel openings 62 with no part extending beyond the tongue 48 in such a way as to interfere with the ability of the tongue to enter the file chamber 26 when the upper portion 14 is put into place on top of the lower portion 12.

A strap attachment staple 66 is attached to each lower portion side 22 at a convenient point below the level of the lower portion rim 24 but preferably above the anticipated center of gravity of the loaded carrying case 10 when in use. Each end of the strap 16 is attached to a strap attachment staple 66 by a buckle, sewing, or other conventional means for so attaching a strap to a staple. Preferably each strap attachment staple 66 has a back plate 68, a face plate 70, and a staple member 72. The staple member 72 passes through the face plate 70 and preferably is rigidly attached to the back plate 68. The distance between the back and face plates 68, 70 is selected to be not less than the thickness of the lower portion ends 20. Preferably each lower portion end 20 has a staple slot 74 extending entirely through the lower portion end at a selected distance below the lower portion rim 24. The length of the staple slot 74 is selected to be sufficient to contain the staple member 72 but not to extend beyond the width of the face plate 70.

The panel 58 may be molded conveniently from a tough plastic, such as a high-density polyurethane. The panel handle 64 may be unitarily molded with the panel 58 or may be made separately and fastened to the panel by glueing or other appropriate means.

Figure 2:
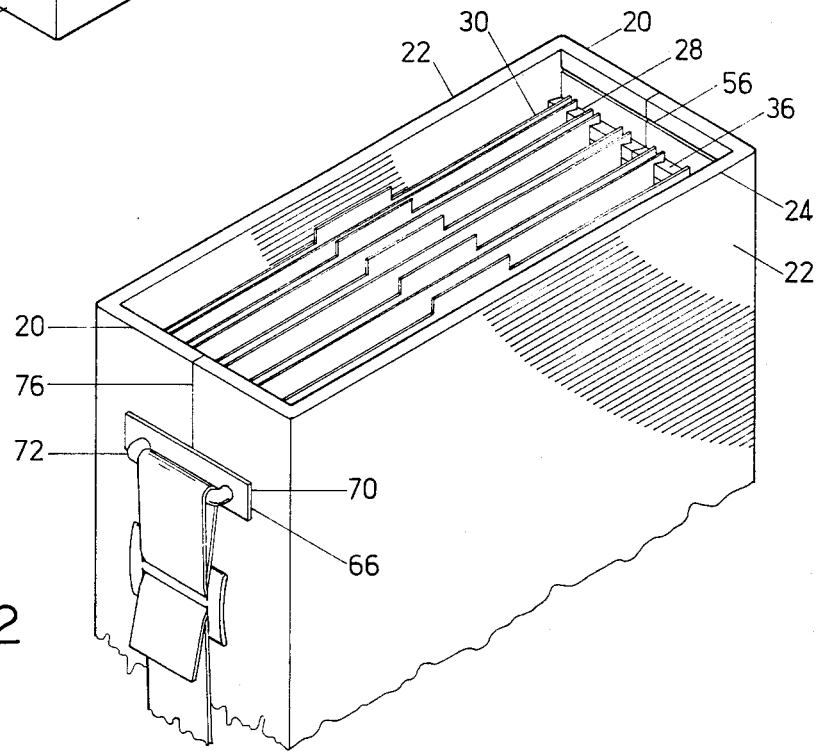
FIG. 2 is a perspective view of the lower portion of the carrying case of FIG. 1 with the upper portion removed.
Figure 3:
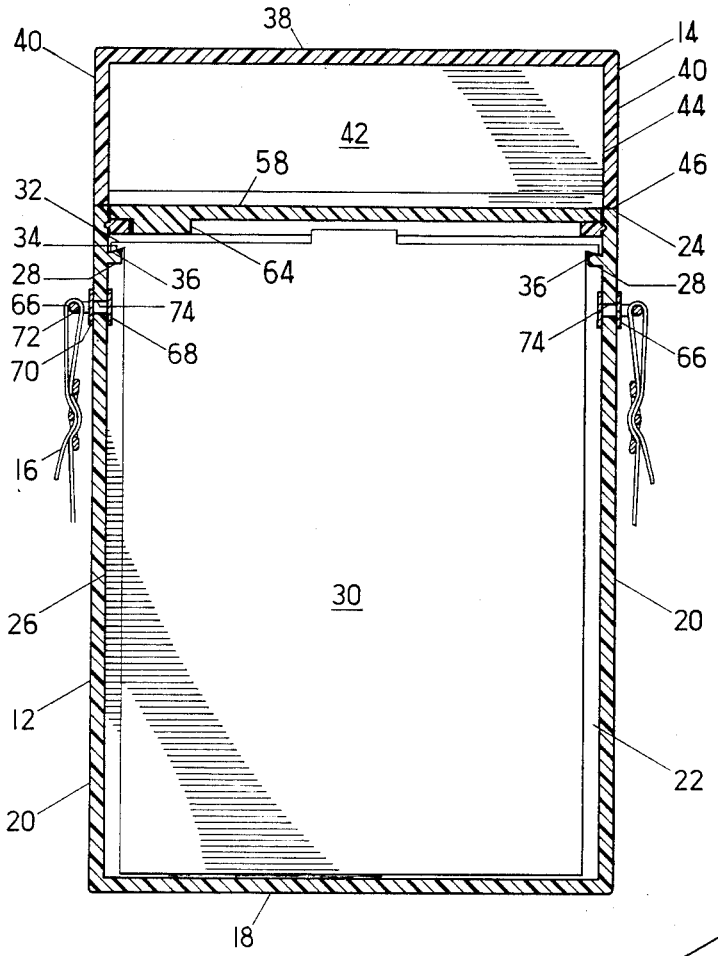
FIG. 3 is a cross-sectional view of the lower portion shown in FIG. 2 taken along section lines 3—3.

The upper and lower portions 14, 12 may likewise be molded from a suitable plastic. Preferably, both the lower portion 12 and upper portion 14 are bilaterally symmetrical about a plane extending parallel to the lower portion and upper portion sides 22, 42. Consequently, they may be molded in identical front and back halves, the lower portion ends and floor 20, 18 and upper portion ends and roof 40, 38 being divided into equal halves. These front and back halves may then be glued together to form complete upper and lower portions 14, 12, with a single seam in each portion, as is indicated by the broken line shown at 76 in FIGS. 2 and 4. Alternatively, these parts may be unitarily molded with no seam.

When identical front and back halves are glued to form upper and lower portions 14, 12, certain advantages result. Thus, the panel 58 may be put into place within the panel slots 60 and panel openings 62 as the two halves of the upper portion 14 are joined to be glued together. By this means, the panel handle 64 can be unitarily molded with the panel 58 and be mounted within the upper portion 14 with the panel handle retaining the panel within the upper portion in the manner disclosed above. As the front and back halves of the lower portion 12 are joined for gluing, a strap attachment staple 66 may be fitted into the staple slot 74 to be retained therein when the front and back halves of the lower portion are glued. By this means, the strap attachment staples 66 may be fastened to the lower portion 12 without the need for any drilling or other assembly procedure. It will be apparent that only one mold each is necessary to make the front and back halves of the upper and lower portions 14, 12, respectively.

Although the methods disclosed above are those preferred for making the carrying case 10 of the invention, it will be apparent that other materials and modes of assembly are possible. It is understood that the present invention is not limited to the particular construction and arrangement of parts illustrated and disclosed above. Instead, it embraces all such modified forms thereof as come within the scope of the following claims.

What is claimed is:

1. A carrying case adapted to conveniently contain writing materials comprising:

(a) a lower portion having inwardly facing surfaces that define an upwardly opening file chamber having a lower portion rim;

(b) an upper portion having inwardly facing surfaces that define a storage chamber having an upper portion rim;

(c) a panel and means for sliding the panel between a closed position and an open position to selectively close and open the storage chamber; and (d) means for removably fastening the upper portion rim to the lower portion rim only when the panel is in its closed position to thereby close the file chamber and constrain the panel within its closed position.

2. The carrying case of claim 1 wherein the means for removably fastening permits removal of the upper portion from the lower portion.

3. The carrying case of claim 1 wherein the lower portion has generally opposed lower portion ends and the upper portion has a roof and upper portion opposed ends and opposed sides, inwardly facing surfaces of the upper portion roof, ends, and sides defining the storage chamber and the upper portion ends and sides terminating to define the upper portion rim at a point remote from the roof, the upper portion also including a raised tongue extending from the upper portion rim in a direction away from the roof, the tongue having a size selected to extend within the file chamber when the upper and lower portion rims are placed adjacent to each other to locate the upper portion on the lower portion, the tongue having opposed tongue sides and ends adjacent respectively to the upper portion sides and ends, the tongue ends having a ridge extending endwardly generally parallel to the upper portion rim, the interior surface of each lower portion end including an indentation having a size and location so selected that a ridge of the upper portion fits therein when the upper and lower portion rims are placed adjacent to each other to retain the upper portion on the lower portion.

4. The carrying case of claim 3 wherein inwardly facing surfaces of each tongue side define panel slots extending parallel to the upper portion rim for substantially the length of the tongue side and at least one tongue end has a panel opening aligned with the panel slots and extending parallel to the upper portion rim, the panel slots and panel opening having a size selected to be sufficient that the panel can readily slide therethrough.

5. The carrying case of claim 4 wherein each tongue end includes a panel opening, and the panel has a size selected to be such that, with the panel in the closed position, the tongue may extend within the file chamber when the upper and lower portion rims are placed adjacent to each other with inwardly facing surfaces of the file chamber so confining the panel as to prevents its moving endwardly from its closed position.

6. The carrying case of claim 5 wherein the panel has a panel handle fastened thereto and having a size such that the panel handle contacts the tongue end through which the panel extends when the panel is moved to its open position so as to prevent the panel from being entirely removed from the upper portion and, when the panel is in its closed position, contacts the other tongue end to prevent movement of the panel beyond its closed position.

7. The carrying case of claim 5 wherein the upper portion is bilaterally symmetrical about a plane extending through the upper portion ends generally parallel to the upper portion sides to define identical front and back upper portion halves, whereupon the upper portion may be conveniently made from identical upper portion halves manufactured from a moldable material in a single mold.

8. The carrying case of claim 1 wherein the lower portion has two lower portion ends and two lower portion sides, upwardly presenting portions of which combine to define the lower portion rim and inwardly facing surfaces thereof at least partly define the upwardly opening file chamber, the lower portion including file hangers protruding inwardly from the ends into the file chamber at a selected distance beneath the level of the lower portion rim, the distance between the file hangers of the lower portion ends being such that selected hanging files may be suspended therefrom.

9. The carrying case of claim 8 adapted to contain hanging files depending from downwardly presenting side hooks located at each upper corner of the hanging file, the side hooks having downwardly extending projections, each file hanger of the carrying case having an upwardly opening trough adapted to receive the downwardly extending projections to help retain the side hooks in place on the file hangers.

10. The carrying case of claim 8 wherein the lower portion is bilaterally symmetrical about a plane extending through the lower portion ends substantially parallel to the lower portion sides to divide the lower portion into identical front and back lower portion halves, whereupon the lower portion may be made by combining identical front and back halves molded from a moldable material in a single mold.

11. The carrying case of claim 3 wherein the lower portion has two lower portion ends and two lower portion sides, upwardly presenting portions of which combine to define the lower portion rim and inwardly facing surfaces thereof at least partly define the upwardly opening file chamber, the lower portion including file hangers protruding inwardly from the ends into the file chamber at a selected distance beneath the level of the lower portion rim, the distance between the file hangers of the lower portion ends being such that selected hanging files may be suspended therefrom.

12. The carrying case of claim 11 adapted to contain hanging files depending from downwardly presenting side hooks located at each upper corner of the hanging file, the side hooks having downwardly extending projections, each file hanger of the carrying case having an upwardly opening trough adapted to receive the downwardly extending projections to help retain the side hooks in place on the file hangers.

13. The carrying case of claim 11 wherein the lower portion is bilaterally symmetrical about a plane extending through the lower portion ends substantially parallel to the lower portion sides to divide the lower portion into identical front and back lower portion halves, whereupon the lower portion may be made by combining identical front and back halves molded from a moldable material in a single mold.

14. The carrying case of claim 7 wherein the lower portion has two lower portion ends and two lower portion sides, upwardly presenting portions of which combine to define the lower portion rim and inwardly facing surfaces thereof at least partly define the upwardly opening file chamber, the lower portion including file hangers protruding inwardly from the ends into the file chamber at a selected distance beneath the level of the lower portion rim, the distance between the file hangers of the lower portion ends being such that selected hanging files may be suspended therefrom.

15. The carrying case of claim 14 adapted to contain hanging files depending from downwardly presenting side hooks located at each upper corner of the hanging file, the side hooks having downwardly extending projections, each file hanger of the carrying case having an upwardly opening trough adapted to receive the downwardly extending projections to help retain the side hooks in place on the file hangers.

16. The carrying case of claim 14 wherein the lower portion is bilaterally symmetrical about a plane extending through the lower portion ends substantially parallel to the lower portion sides to divide the lower portion into identical front and back lower portion halves, whereupon the lower portion may be made by combining identical front and back halves molded from a moldable material in a single mold.

* * * * *